US009290972B2

(12) United States Patent
Tarr et al.

(10) Patent No.: US 9,290,972 B2
(45) Date of Patent: Mar. 22, 2016

(54) LATCH ASSEMBLY

(71) Applicant: General Electric Company, Schenectady, NY (US)

(72) Inventors: Ronald Scott Tarr, Louisville, KY (US); Srinivas Mallampalli, Louisville, KY (US)

(73) Assignee: General Electric Company, Schenectady, NY (US)

( * ) Notice: Subject to any disclaimer, the term of this patent is extended or adjusted under 35 U.S.C. 154(b) by 144 days.

(21) Appl. No.: 14/053,675

(22) Filed: Oct. 15, 2013

(65) Prior Publication Data

US 2015/0102612 A1 Apr. 16, 2015

(51) Int. Cl.

| | |
|---|---|
| ***E05C 17/56*** | (2006.01) |
| ***E05C 19/16*** | (2006.01) |
| ***D06F 39/14*** | (2006.01) |
| *D06F 58/04* | (2006.01) |
| *D06F 58/20* | (2006.01) |
| *A47L 15/42* | (2006.01) |

(52) U.S. Cl.

CPC ..... *E05C 19/16* (2013.01); *D06F 39/14* (2013.01); *E05C 17/56* (2013.01); *A47L 15/4259* (2013.01); *D06F 58/04* (2013.01); *D06F 58/20* (2013.01); *Y10T 292/11* (2015.04)

(58) Field of Classification Search

CPC ..... Y10S 292/69; E05C 17/56; E05C 19/16; E05C 19/161; E05C 19/163; E05C 19/166; E05C 19/168; E05D 15/0073; E05F 7/005

USPC ..... 292/8–10, 16, 251.5, 341.12, 341.13, 292/342, 343, DIG. 39, DIG. 51, DIG. 55, 292/DIG. 69, DIG. 73; 16/82

See application file for complete search history.

(56) References Cited

U.S. PATENT DOCUMENTS

| | | | | | |
|---|---|---|---|---|---|
| 1,198,227 | A | * | 9/1916 | Hinchey | 292/251.5 |
| 1,239,441 | A | * | 9/1917 | Allmand | 16/86 A |
| 1,561,726 | A | * | 11/1925 | Kerr | 16/85 |
| 1,654,163 | A | * | 12/1927 | Evans | 292/300 |
| 1,840,061 | A | * | 1/1932 | Stutson | 16/85 |
| 1,888,829 | A | * | 11/1932 | Moore | 16/85 |
| 1,893,639 | A | * | 1/1933 | Stutson | 16/86 B |
| 1,903,365 | A | * | 4/1933 | Haskins et al. | 16/86 B |
| 1,947,524 | A | * | 2/1934 | Horldt | 16/85 |
| 2,438,231 | A | * | 3/1948 | Schultz et al. | 401/244 |

(Continued)

FOREIGN PATENT DOCUMENTS

| | | | |
|---|---|---|---|
| DE | 20200800561 | U1 | 9/2009 |
| EP | 0550897 | A2 | 7/1993 |

(Continued)

OTHER PUBLICATIONS

PCT Search Report and Written Opinion issued in connection with corresponding PCT Application No. PCT/US2014/057078 on Mar. 24, 2015.

*Primary Examiner* — Carlos Lugo

(74) *Attorney, Agent, or Firm* — Dority & Manning, P.A.

(57) ABSTRACT

A latch assembly is provided. The latch assembly includes a stator and a mover. Magnets are mounted to the stator and/or the mover. The magnets assist with holding the latch mechanism is in a closed position. A position and orientation of the magnets also assists with shaping the force required to open the latch mechanism.

16 Claims, 9 Drawing Sheets

(56) References Cited

U.S. PATENT DOCUMENTS

| | | | | | |
|---|---|---|---|---|---|
| 2,521,885 | A | * | 9/1950 | Vasquez | 292/251.5 |
| 2,586,900 | A | * | 2/1952 | Alderman | 292/74 |
| 2,761,722 | A | * | 9/1956 | Wilfert et al. | 292/341.12 |
| 2,812,203 | A | | 11/1957 | Scholten | |
| 2,854,273 | A | | 9/1958 | Cunningham | |
| 3,261,628 | A | * | 7/1966 | Kesling | 292/70 |
| 4,425,771 | A | * | 1/1984 | Beach et al. | 70/276 |
| 5,243,771 | A | * | 9/1993 | Kretchman et al. | 34/108 |
| 5,865,482 | A | * | 2/1999 | Aoki | 292/251.5 |
| 5,868,445 | A | * | 2/1999 | Kaufman et al. | 292/251.5 |
| 7,165,792 | B2 | * | 1/2007 | Queveau et al. | 292/251.5 |
| 7,234,739 | B2 | | 6/2007 | Saitoh et al. | |
| 7,654,590 | B2 | | 2/2010 | Hapke | |
| 7,766,399 | B2 | * | 8/2010 | Howey | 292/251.5 |
| 2010/0283269 | A1 | * | 11/2010 | Fiedler | 292/251.5 |
| 2010/0308605 | A1 | * | 12/2010 | Fiedler | 292/251.5 |
| 2015/0115630 | A1 | * | 4/2015 | Tarr et al. | 292/251.5 |

FOREIGN PATENT DOCUMENTS

| | | | | |
|---|---|---|---|---|
| EP | 2302150 | | * | 3/2011 |
| FR | 1201673 | A | | 1/1960 |
| WO | WO 0015937 | A1 | * | 3/2000 |
| WO | 2009130080 | A1 | | 10/2009 |

* cited by examiner

LATCH ASSEMBLY

FIELD OF THE INVENTION

The present subject matter relates generally to latch assemblies, such as latch assemblies suitable for use in appliances.

BACKGROUND OF THE INVENTION

Certain appliances include mechanical latch assemblies for holding doors of the appliances in a closed position. Such mechanical latch assemblies are generally burst type latch assemblies where a user pulls on the door until a holding force is overcome and the door opens. Similarly, the user pushes on the door to overcome a resistance force of the burst type latch assembly and close the door. Overcoming the holding force of the burst type latch assembly to open the door can be difficult and inconvenient. Likewise, overcoming the resistance force of the burst type latch assembly to close the door can be difficult and inconvenient. In particular, the door may not properly close if the user fails to fully overcome the resistance force of the burst type latch assembly.

Magnetic latch assemblies are also available to hold doors closed. Such magnetic latch assemblies generally include a magnet that draws a door shut without a user applying any force to the door. However, opening the door can be difficult because an initial opening force of the magnetic latch assembly can be quite high due to the force versus displacement characteristics of the magnet.

Accordingly, a magnetic latch assembly that draws a door closed while also being easy to open would be useful.

BRIEF DESCRIPTION OF THE INVENTION

The present subject matter provides a latch assembly. The latch assembly includes a stator and a mover. Magnets are mounted to the stator and/or the mover. The magnets assist with holding the latch mechanism is in a closed position. A position and orientation of the magnets also assists with shaping the force required to open the latch mechanism. Additional aspects and advantages of the invention will be set forth in part in the following description, or may be apparent from the description, or may be learned through practice of the invention.

In a first exemplary embodiment, a latch mechanism is provided. The latch mechanism includes a stator having a first end portion and a second end portion. A first magnet is positioned at the first end portion of the stator. The first magnet has an outer surface and a central axis. A second magnet is positioned at the second end portion of the stator. The second magnet has an outer surface and a central axis. A mover has a first end portion and a second end portion. A third magnet is positioned at the first end portion of the mover. The third magnet has an outer surface and a central axis. The outer surface of the third magnet is positioned at the outer surface of the first magnet when the latch mechanism is in a closed position. The central axis of the third magnet is substantially parallel to the central axis of the first magnet when the latch mechanism is in the closed position. A fourth magnet is positioned at the second end portion of the mover. The fourth magnet has an outer surface and a central axis. The outer surface of the fourth magnet is positioned at the outer surface of the second magnet when the latch mechanism is in the closed position. The central axis of the fourth magnet is substantially parallel to the central axis of the second magnet when the latch mechanism is in the closed position.

In a second exemplary embodiment, a latch assembly is provided. The latch assembly defines a lateral direction and a transverse direction. The lateral and transverse directions are perpendicular to each other. The latch assembly includes a stator having a first end portion and a second end portion. The first and second end portions of the stator are spaced apart from each other along the lateral direction. A first magnet is mounted to the stator at the first end portion of the stator. The first magnet has an outer surface. A second magnet is mounted to the stator at the second end portion of the stator. The second magnet has an outer surface. A mover has a first end portion and a second end portion. The first and second end portions of the mover are spaced apart from each other along the lateral direction. A third magnet is mounted to the mover at the first end portion of the mover. The third magnet has an outer surface. The outer surface of the third magnet faces the outer surface of the first magnet when the latch assembly is in a closed position. The outer surface of the third magnet overlaps the outer surface of the first magnet when the latch assembly is in the closed position. A fourth magnet is positioned at the second end portion of the mover. The fourth magnet having an outer surface. The outer surface of the fourth magnet faces the outer surface of the second magnet when the latch assembly is in the closed position. The outer surface of the fourth magnet overlaps the outer surface of the second magnet when the latch assembly is in the closed position.

In a third exemplary embodiment, a latch assembly is provided. The latch assembly defines a lateral direction and a transverse direction. The lateral and transverse directions are perpendicular to each other. The latch assembly includes a stator having a first end portion and a second end portion. The first and second end portions of the stator are spaced apart from each other along the lateral direction. A mover has a first end portion and a second end portion. The first and second end portions of the mover are spaced apart from each other along the lateral direction. A first magnet is positioned at the first end portion of the stator and the first end portion of the mover when the latch assembly is in a closed position. The first magnet has an outer surface and a central axis. A second magnet is positioned at the second end portion of the stator and the second end portion of the mover when the latch assembly is in the closed position. The second magnet has an outer surface and a central axis. The central axis of the second magnet and the central axis of the first magnet defines an angle $\gamma$ therebetween. The angle $\gamma$ is between about one hundred and ten degrees and about one hundred and thirty degrees.

In a fourth exemplary embodiment, an appliance is provided. The appliance includes a cabinet and a door rotatably mounted to the cabinet. The appliance also includes a latch assembly for selectively holding the door in a closed position. The latch assembly includes a first magnet mounted to the door and a second magnet mounted to the cabinet. The first magnet has an outer surface and a central axis. A second magnet has an outer surface and a central axis. The outer surface of the second magnet is positioned adjacent the outer surface of the first magnet when the door is in the closed position. The central axis of the second magnet is substantially parallel to the central axis of the first magnet when the door is in the closed position.

In a fifth exemplary embodiment, a latch mechanism is provided. The latch assembly defines a lateral direction. The latch assembly includes a stator. The stator has a first end portion and a second end portion that are spaced apart from each other along the lateral direction. A first magnet is positioned at the first end portion of the stator. The first magnet has an outer surface. A second magnet is positioned at the second end portion of the stator. The second magnet has an outer surface. A third magnet has a pair of outer surfaces. The third magnet is positioned between the first and second magnets when the latch assembly is in a closed position such that each outer surface of the pair of outer surfaces of the third magnet faces and is substantially parallel to a respective one of the outer surface of the first magnet and the outer surface of the second magnet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
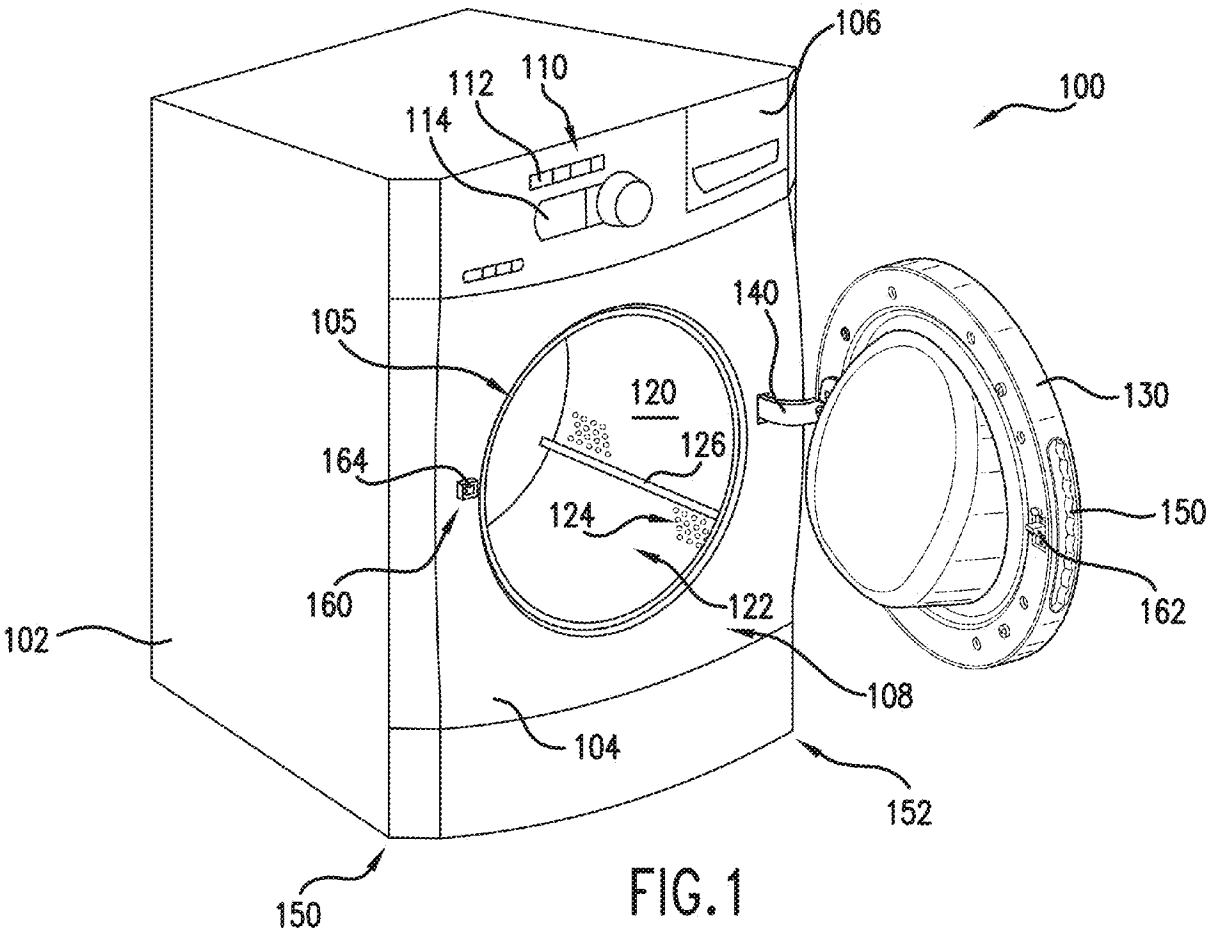
FIG. 1 provides a perspective view of a washing machine appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a top plan view of an exemplary washing machine appliance 100. Using the teachings disclosed herein, it will be understood that washing machine appliance 100 is provided by way of example only. Other washing machine appliances having different configurations, different appearances, and/or different features may also be utilized with the present subject matter as well.

Washing machine appliance 100 has a cabinet 102 with a drum 120 rotatably mounted therein. A motor (not shown) is in mechanical communication with drum 120 in order to selectively rotate drum 120 (e.g., during an agitation or a rinse cycle of washing machine appliance 100). Drum 120 defines a wash chamber 122 that is configured for receipt of articles for washing. Ribs 126 extend from drum 120 into wash chamber 122. Ribs 126 assist agitation of articles disposed within wash chamber 122 during operation of washing machine appliance 100. For example, ribs 126 may lift articles disposed in drum 120 during rotation of drum 120. Drum 120 also defines a plurality of holes 124. Holes 124 are configured to permit a flow of wash fluid between an interior of drum 120 and an exterior of drum 120.

Cabinet 102 of washing machine appliance 100 has a front panel 104. A detergent drawer 106 is slidably mounted within front panel 104. Detergent drawer 106 receives detergent and directs said detergent to wash chamber 122 during operation of appliance 100. Front panel 104 defines an opening 105 that permits user access to wash chamber 122 of drum 120. A door 130 is mounted to front panel 104 with a hinge 140. A latch assembly 160 with a male latch portion or mover 162 and a female latch portion or stator 164 is configured for selectively securing door 130 in a closed configuration (i.e., a configuration in which door 130 is positioned adjacent front panel 104).

Door 130 provides selective access to wash chamber 122. A user may selectively adjust door 130 between a closed positioned (not shown) and an open position (shown in FIG. 1) in which the user may access wash chamber 122 of drum 120. A user may adjust door 130 between the open and closed configurations by rotating door 130 about hinge 140. For example, to open door 130 from closed configuration, the user may pull on a handle 150 in order to rotate door 130 open.

Front panel 104 also includes a control panel 110 with a plurality of input selectors 112. Control panel 110 and input selectors 112 collectively form a user interface input for operator selection of machine cycles and features. A display 114 of control panel 110 indicates selected features, a countdown timer, and/or other items of interest to appliance users.

Figure 2:
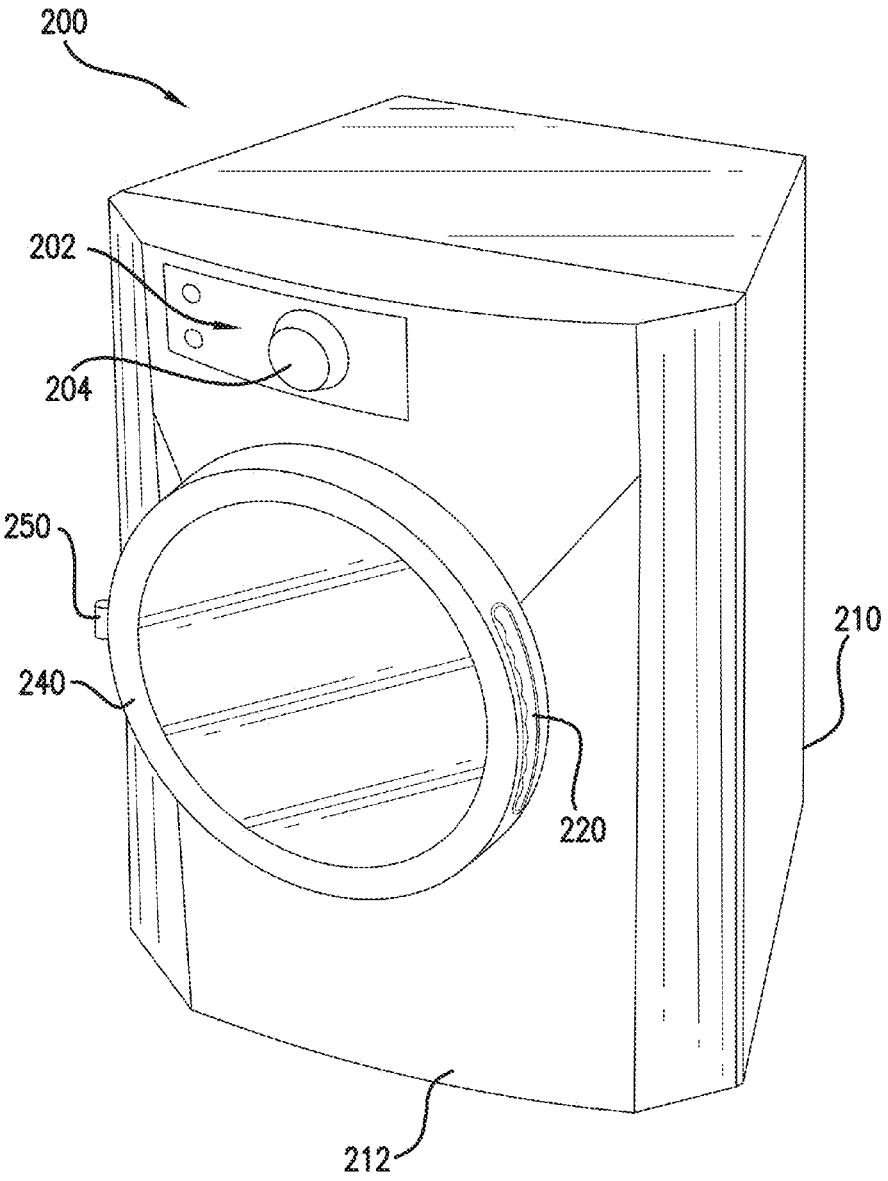
FIG. 2 provides a perspective view of a dryer appliance according to an exemplary embodiment of the present subject matter.

FIG. 2 provides a perspective view of a dryer appliance 200 according to an exemplary embodiment of the present subject matter. However, while described in the context of a specific embodiment of dryer appliance 200, using the teachings disclosed herein it will be understood that dryer appliance 200 is provided by way of example only. Other dryers having different appearances and different features may also be utilized with the present invention as well.

Dryer appliance 200 includes a main housing or cabinet 210 with a drum (not shown) rotatably mounted therein. The drum defines a drying chamber configured for receipt of articles for drying. Cabinet 210 has a door 240 rotatably mounted to a front panel 212 with a hinge 250. Door 240 provides selective access to the drying chamber. A user may selectively adjust door 240 between a closed positioned (shown in FIG. 2) and an open position (not shown) in which the user may access the drying chamber. To open door 240 from closed configuration shown in FIG. 2, a user may pull on handle 220 in order to rotate door 240 open. Dryer appliance 200 also includes a latch assembly (not shown) for selectively securing door 240 in the closed position.

Front panel 212 also includes a control panel 202 with an input selector 204. Control panel 202 and input selector 204 collectively form a user interface input for operator selection of machine cycles and features.

Figure 3:
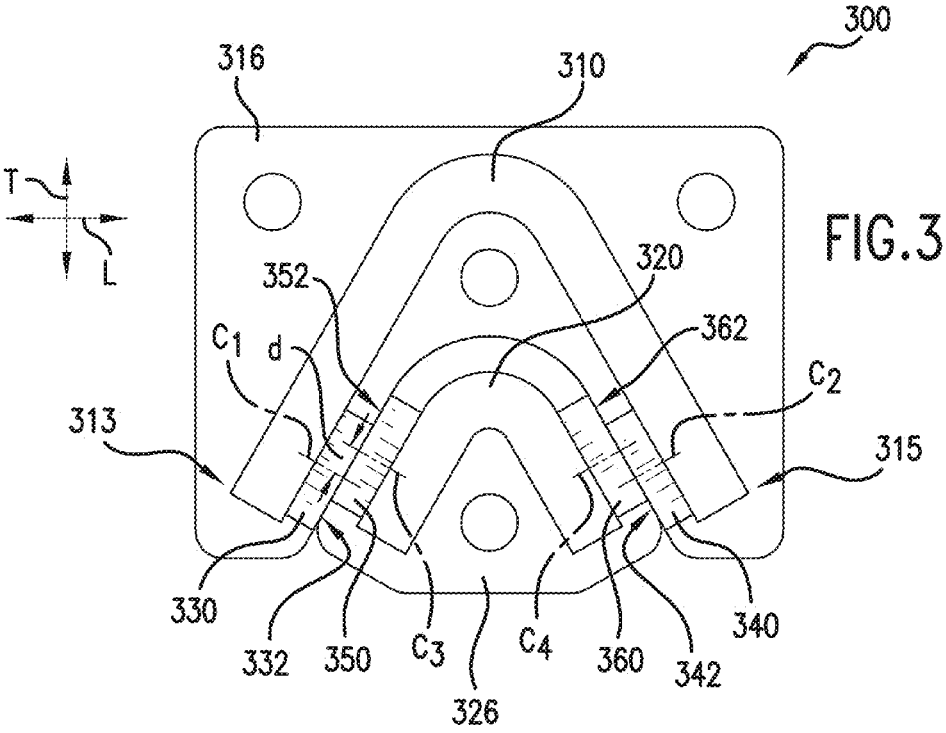
FIGS. 3, 4 and 5 provide top, elevation views of a latch assembly according to an exemplary embodiment of the present subject matter with a mover of the exemplary latch assembly shown in various positions relative to a stator of the exemplary latch assembly.
Figure 4:
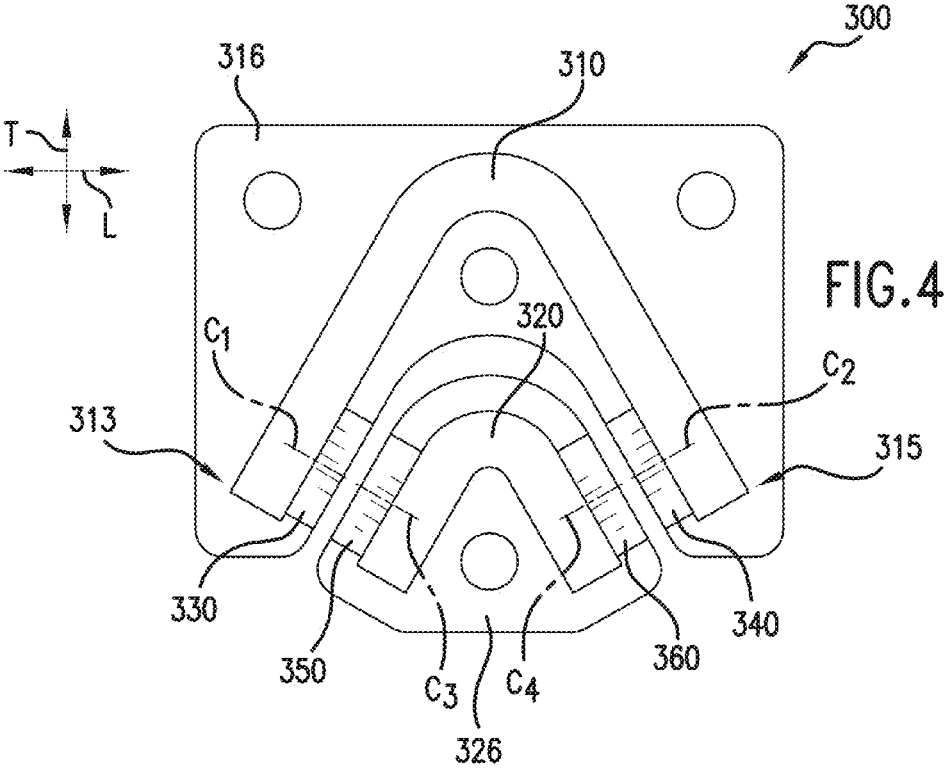
Figure 5:
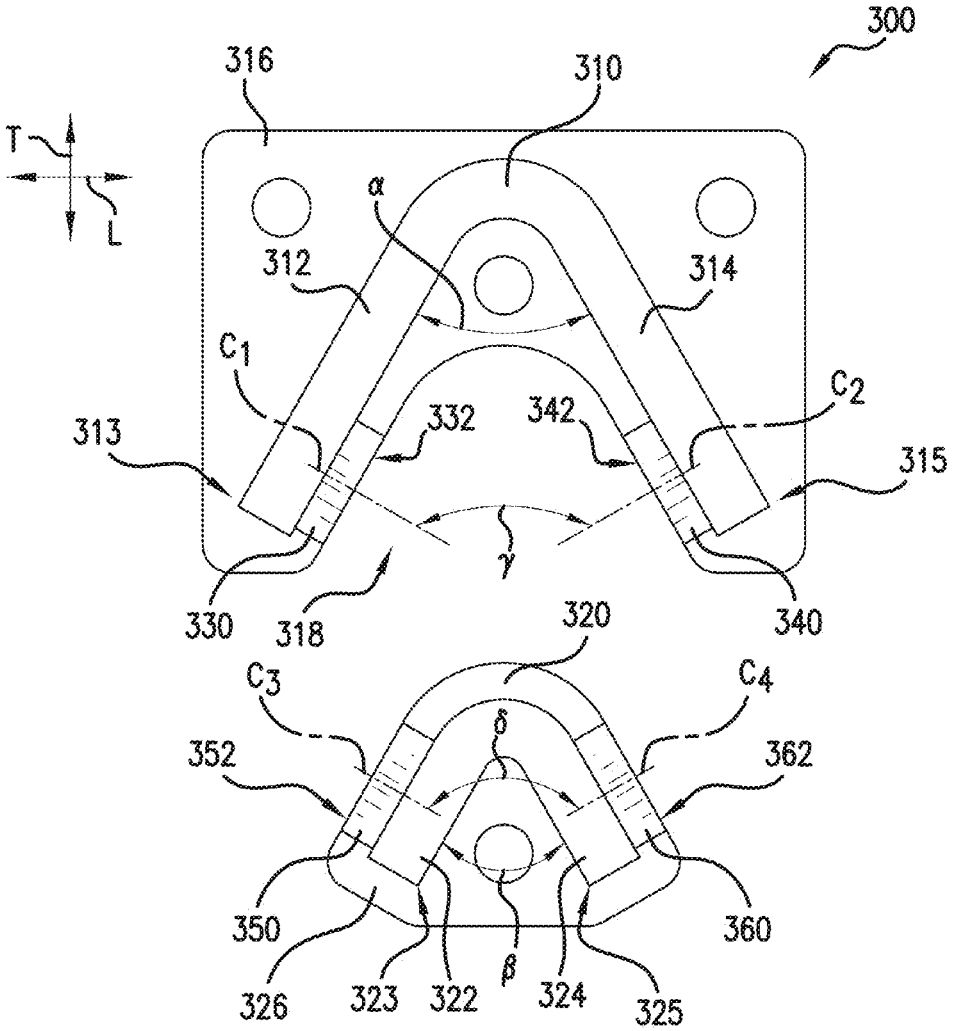

FIGS. 3, 4 and 5 provide top, elevation views of a latch assembly 300 according to an exemplary embodiment of the present subject matter. In FIGS. 3, 4 and 5, a mover 320 of latch assembly 300 is shown in various positions relative to a back iron or stator 310 of latch assembly 300. In FIG. 4, latch assembly 300 is shown in a closed position. Conversely, latch assembly 300 is shown in an open position in FIG. 5. Latch assembly 300 is shown in a position between the open and closed positions in FIG. 4. A user can selective adjust latch assembly 300 between the open and closed positions.

Latch assembly 300 can be used for any suitable purpose. As an example, latch assembly 300 may be used on an appliance, such as washing machine appliance 100 (FIG. 1) or dryer appliance 200 (FIG. 2). As another example, latch assembly 300 may be used on a microwave appliance, a dishwasher appliance, a trash compactor, an oven appliance, etc. As will be understood by those skilled in the art, latch assembly 300 may be used to selectively secure a door of such appliances in a closed position. As an example, mover 320 may be mounted to a door of such appliances, and stator 310 may be mounted to a cabinet of such appliances. As another example, mover 320 may be mounted to the cabinet of such appliances, and stator 310 may be mounted to the door of such appliances.

Latch assembly 300 defines a lateral direction L and a transverse direction T. The lateral direction L and the transverse direction T are perpendicular to each other. The lateral direction L and the transverse direction T may also both be perpendicular to a vertical direction (not shown), e.g., to form an orthogonal direction system.

As may be seen in FIGS. 3, 4 and 5, latch assembly 300 includes stator 310, mover 320, a first magnet 330, a second magnet 340, a third magnet 350 and a fourth magnet 360. First and second magnets 330 and 340 are mounted to stator 310. Conversely, third and fourth magnets 350 and 360 are mounted to mover 320. As discussed in greater detail below, first and second magnets 330 and 340 engage and third and fourth magnets 350 and 360 to hold latch assembly 300 in the closed position (shown in FIG. 3). The position and orientation of first, second, third and fourth magnets 330, 340, 350 and 360 assist with shaping the force required to shift latch assembly 300 from the closed position to the open position (shown in FIG. 5). Such features of latch assembly 300 are discussed in greater detail below.

As may be seen in FIG. 5, stator 310 has a first portion 312 and a second portion 314. First and second portions 312 and 314 of stator 310 are spaced apart from each other, e.g., along the lateral direction L. First and second portions 312 and 314 of stator 310 define a U-shape or a V-shape, e.g., in a plane that is perpendicular to the vertical direction. In particular, first and second portions 312 and 314 of stator 310 define an angle $\alpha$ therebetween. The angle $\alpha$ can be any suitable angle. As an example, the angle $\alpha$ may be between about zero degrees and about one hundred degrees or may be between about fifty degrees and about seventy degrees.

Stator 310 also extends between a first end portion 313 and a second end portion 315. First end portion 313 of stator 310 is positioned at first portion 312 of stator 310. Conversely, second end portion 315 of stator 310 is positioned at second portion 314 of stator 310. Thus, as may be seen in FIG. 5, first and second end portions 313 and 315 of stator 310 are spaced apart from each other, e.g., along the lateral direction L. First magnet 330 is mounted to stator 310 at first end portion 313 of stator 310, and second magnet 340 is mounted to stator 310 at second end portion 315 of stator 310. Thus, first and second magnets 330 and 340 are spaced apart from each other, e.g., along the lateral direction L.

Stator 310 is mounted to a stator holder 316. Stator holder 316 defines a recess 318 (FIG. 5). Recess 318 of stator holder 316 is configured for receipt of mover 320 when latch assembly 300 is in the closed position.

Stator 310 can be constructed of any suitable material. In certain exemplary embodiments, stator 310 is constructed of a material having a relatively high conductivity. As an example, stator 310 may be constructed of a metal, such as steel. Stator holder 316 can also be constructed of any suitable material. In certain exemplary embodiments, stator holder 316 is constructed of a material having a relatively low conductivity. As an example, stator holder 316 may be constructed of a plastic.

As discussed above, first magnet 330 is positioned at first end portion 313 of stator 310. First magnet 330 has an outer surface 332 and a central axis $C_1$. Central axis $C_1$ of first magnet 330 may be substantially normal or perpendicular to outer surface 332 of first magnet 330. In particular, central axis $C_1$ of first magnet 330 may be a line or axis that passes through a center or centroid of first magnet 330 and is substantially perpendicular to outer surface 332 of first magnet 330.

Second magnet 340 is positioned at second end portion 315 of stator 310. Second magnet 340 also has an outer surface 342 and a central axis $C_2$. Central axis $C_2$ of second magnet 340 may be substantially normal or perpendicular to outer surface 342 of second magnet 340. In particular, central axis $C_2$ of second magnet 340 may be a line or axis that passes through a center or centroid of second magnet 340 and is substantially perpendicular to outer surface 342 of second magnet 340.

Poles of first and second magnets 330 and 340 may be oriented to assist with shaping the holding force of latch assembly 300. For example, a southern pole of first magnet 330 may be positioned at or adjacent outer surface 332 of first magnet 330, and a northern pole of first magnet 330 may be positioned at an opposite side of first magnet 330, e.g., adjacent or at first end portion 313 of stator 310. Conversely, a northern pole of second magnet 340 may be positioned at or adjacent outer surface 342 of second magnet 340, and a southern pole of second magnet 340 may be positioned at an opposite side of second magnet 340, e.g., adjacent or at second end portion 315 of stator 310. Such alignment can assist with coupling first and second magnets 330 and 340 when latch assembly 300 is closed as will be understood by those skilled in the art. It should be understood that the orientation of the poles of first and second magnets 330 and 340 can be any suitable orientation in alternative exemplary embodiments.

Like stator 310, mover 320 has a first portion 322 and a second portion 324 as shown in FIG. 5. First and second portions 322 and 324 of mover 320 are spaced apart from each other, e.g., along the lateral direction L. First and second portions 322 and 324 of mover 320 define a U-shape or a V-shape, e.g., in a plane that is perpendicular to the vertical direction, such that mover 320 is complementary in shape to stator 310. In particular, first and second portions 322 and 324 of mover 320 define an angle β therebetween. The angle β can be any suitable angle. As an example, the angle β may be between about zero degrees and about one hundred degrees or may be between about fifty degrees and about seventy degrees.

Mover 320 also extends between a first end portion 323 and a second end portion 325. First end portion 323 of mover 320 is positioned at first portion 322 of mover 320. Conversely, second end portion 325 of mover 320 is positioned at second portion 324 of mover 320. Thus, as may be seen in FIG. 5, first and second end portions 323 and 325 of mover 320 are spaced apart from each other, e.g., along the lateral direction L. Third magnet 350 is mounted to mover 320 at first end portion 323 of mover 320, and fourth magnet 360 is mounted to mover 320 at second end portion 325 of mover 320. Thus, third and fourth magnets 350 and 360 are spaced apart from each other, e.g., along the lateral direction L.

Mover 320 is mounted to a mover holder 326. Mover holder 326 is shaped for receipt within recess 318 of stator holder 316 when latch assembly 300 is in the closed position. Mover 320 can be constructed of any suitable material. In certain exemplary embodiments, mover 320 is constructed of a material having a relatively high conductivity. As an example, mover 320 may be constructed of a metal, such as steel. Mover holder 326 can also be constructed of any suitable material. In certain exemplary embodiments, mover holder 326 is constructed of a material having a relatively low conductivity. As an example, mover holder 326 may be constructed of a plastic.

As discussed above, third magnet 350 is positioned at first end portion 323 of mover 320. Third magnet 350 has an outer surface 352 and a central axis $C_3$. Central axis $C_3$ of third magnet 350 may be substantially normal or perpendicular to outer surface 352 of third magnet 350. In particular, central axis $C_3$ of third magnet 350 may be a line or axis that passes through a center or centroid of third magnet 350 and is substantially perpendicular to outer surface 352 of third magnet 350.

Fourth magnet 360 is positioned at second end portion 325 of mover 320. Fourth magnet 360 also has an outer surface 362 and a central axis $C_4$. Central axis $C_4$ of fourth magnet 360 may be substantially normal or perpendicular to outer surface 362 of fourth magnet 360. In particular, central axis $C_4$ of fourth magnet 360 may be a line or axis that passes through a center or centroid of fourth magnet 360 and is substantially perpendicular to outer surface 362 of fourth magnet 360.

Poles of third and fourth magnets 350 and 360 may be oriented to assist with shaping the holding force of latch assembly 300. For example, a northern pole of third magnet 350 may be positioned at or adjacent outer surface 352 of third magnet 350, and a southern pole of third magnet 350 may be positioned at an opposite side of third magnet 350, e.g., adjacent or at first end portion 323 of mover 320. Conversely, a southern pole of fourth magnet 360 may be positioned at or adjacent outer surface 362 of fourth magnet 360, and a northern pole of fourth magnet 360 may be positioned at an opposite side of fourth magnet 360, e.g., adjacent or at second end portion 325 of mover 320. Such alignment can assist with coupling third and fourth magnets 350 and 360 when latch assembly 300 is closed as will be understood by those skilled in the art. In particular, the orientation of the poles of first, second, third and fourth magnets 330, 340, 350 and 360 can be complementary in order to increase a magnitude of the attractive force between such magnets. It should be understood that the orientation of the poles of third and fourth magnets 350 and 360 can be any suitable orientation in alternative exemplary embodiments.

As discussed above, the position and orientation of first, second, third and fourth magnets 330, 340, 350 and 360 relative to each other can assist with shaping the force required to shift latch assembly 300 from the closed position (shown in FIG. 3) to the open position (shown in FIG. 5). As may be seen in FIG. 3, outer surface 352 of third magnet 350 is positioned at or adjacent outer surface 332 of first magnet 330 when latch assembly 300 is in the closed position, e.g., such that outer surface 332 of first magnet 330 is substantially parallel to outer surface 352 of third magnet 350. In particular, outer surface 352 of third magnet 350 overlaps outer surface 332 of first magnet 330 when latch assembly 300 is in the closed position. For example, when latch assembly 300 is in the closed position, only a portion of outer surface 352 of third magnet 350 faces or contacts outer surface 332 of first magnet 330. In addition, central axis $C_3$ of third magnet 350 is substantially parallel to and spaced apart from central axis $C_1$ of first magnet 330 when latch mechanism 300 is in the closed position. In particular, central axis $C_3$ of third magnet 350 is spaced apart from central axis $C_1$ of the first magnet 340 by a distance d when latch assembly 300 is in the closed position. The distance d can be any suitable distance. For example, the distance d may be greater than about one millimeter and less than about eight millimeters. Central axis $C_4$ of fourth magnet 360 can be similarly spaced apart from central axis $C_2$ of the second magnet 350.

As may be seen in FIG. 3, outer surface 362 of fourth magnet 360 is also positioned at or adjacent outer surface 342 of second magnet 340, e.g., such that outer surface 342 of second magnet 340 is substantially parallel to outer surface 362 of fourth magnet 360, when latch assembly 300 is in the closed position. In particular, outer surface 362 of fourth magnet 360 overlaps outer surface 342 of second magnet 340 when latch assembly 300 is in the closed position. For example, when latch assembly 300 is in the closed position, only a portion of outer surface 362 of fourth magnet 360 faces or contacts outer surface 342 of second magnet 340. In addition, central axis $C_4$ of fourth magnet 360 is substantially parallel to and spaced apart from central axis $C_2$ of second magnet 340 when latch mechanism 300 is in the closed position.

As may be seen in FIG. 5, outer surface 332 of first magnet 330 and outer surface 342 of second magnet 340 are angled to each other, e.g., in a plane that is perpendicular to the vertical direction. In particular, central axis $C_1$ of first magnet 330 and central axis $C_2$ of second magnet 340 define an angle γ therebetween, e.g., in a plane that is perpendicular to the vertical direction. The angle γ can be any suitable angle. For example, the angle γ may be between about ninety degrees and about one hundred and eighty degrees, between about one hundred and ten degrees and about one hundred and sixty degrees or between about one hundred and ten degrees and about one hundred and thirty degrees. Outer surface 352 of third magnet 350 and outer surface 362 of fourth magnet 360 are also angled to each other, e.g., in a plane that is perpendicular to the vertical direction. In particular, central axis $C_3$ of third magnet 350 and central axis $C_4$ of fourth magnet 360 define an angle δ therebetween, e.g., in a plane that is perpendicular to the vertical direction. The angle δ can be any suitable angle. For example, the angle δ may be between about ninety degrees and about one hundred and eighty degrees, between about one hundred and ten degrees and about one hundred and sixty degrees or between about one hundred and ten degrees and about one hundred and thirty degrees.

In certain exemplary embodiments, a surface area of outer surface 332 of first magnet 330 and a surface area of outer surface 342 of second magnet 340 are about equal, and a surface area of outer surface 352 of third magnet 350 and a surface area of outer surface 362 of fourth magnet 360 are also about equal. In particular, the surface area of outer surface 332 of first magnet 330, the surface area of outer surface 342 of second magnet 340, the surface area of outer surface 352 of third magnet 350 and the surface area of outer surface 362 of fourth magnet 360 may be about equal.

Figure 9:
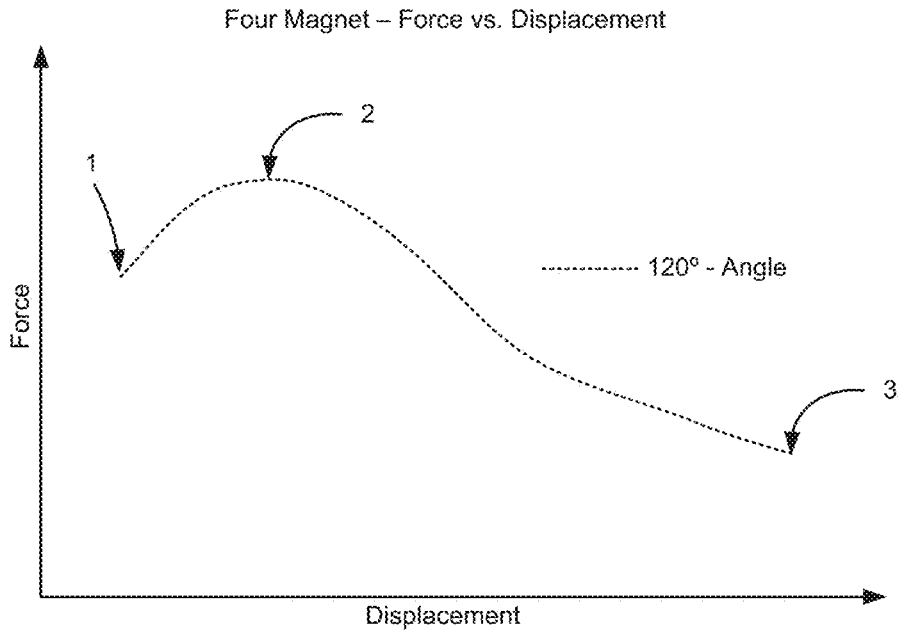
FIG. 9 illustrates another exemplary graph of a force applied by a latch assembly verses displacement of a mover of the latch assembly from a stator of the latch assembly.

FIG. 9 illustrates an exemplary graph of a force applied by latch assembly 300 verses displacement of mover 320 of latch assembly 300 from stator 310 of latch assembly 300. Operation of latch assembly 300 is described below with reference to FIG. 9. In FIG. 9, the point labeled "1" corresponds latch assembly 300 in the closed position as shown in FIG. 3, the point labeled "3" corresponds to latch assembly 300 in the open position shown in FIG. 5 and the point labeled "2" corresponds to latch assembly 300 in the position shown in FIG. 4. It should be understood the graph of FIG. 9 is provided by way of example only and is not intended to limit the present subject matter to the force versus displacement curve shown in FIG. 9.

As may be seen in FIG. 9, the force applied by latch assembly 300 decreases from point 2 to point 1 and from point 2 to point 3. Thus, point 2 corresponds to a peak force applied by latch assembly 300. As may be seen in FIG. 4, outer surface 332 of first magnet 330 and outer surface 352 of third magnet 350 face each other and are aligned at point 2. Similarly, outer surface 342 of second magnet 340 and outer surface 362 of fourth magnet 360 also face each other and are aligned at point 2. Conversely, as may be seen in FIG. 3, outer surface 332 of first magnet 330 and outer surface 352 of third magnet 350 overlap each other and are not aligned at point 1 when mover 320 is inserted into stator 310 and latch assembly 300 is in the closed position. Similarly, outer surface 342 of second magnet 340 and outer surface 362 of fourth magnet 360 overlap each other and are not aligned at point 1. In such manner, the force applied by latch assembly 300 decreases as mover 320 is inserted into stator 310 and latch assembly 300 approaches the closed position.

It should be understood that latch assembly 300 need not include all of first, second, third and fourth magnets 330, 340, 350 and 360. As an example, latch assembly 300 may include only first and third magnets 330 and 350. As another example, latch assembly 300 may include only second and fourth magnets 340 and 360. Thus, latch assembly 300 may include two magnets rather than four magnets. In such exemplary embodiments, a magnitude of the force applied by latch assembly 300 may be reduced while maintaining the same shape shown in FIG. 9. In such exemplary embodiments, first magnet 330 or second magnet 340 may be mounted to door 130 of washing machine appliance 100 (FIG. 1) or door 240 of dryer appliance 200 (FIG. 2), and third magnet 350 or fourth magnet 360 may be mounted to cabinet 102 of washing machine appliance 100 or cabinet 210 of dryer appliance 200. It should be understood that latch assembly 300 also need not include stator 310 and/or mover 320 in certain exemplary embodiments. In such a manner, the magnitude of the force applied by latch assembly 300 may also be reduced while maintaining the same shape shown in FIG. 9.

Figure 6:
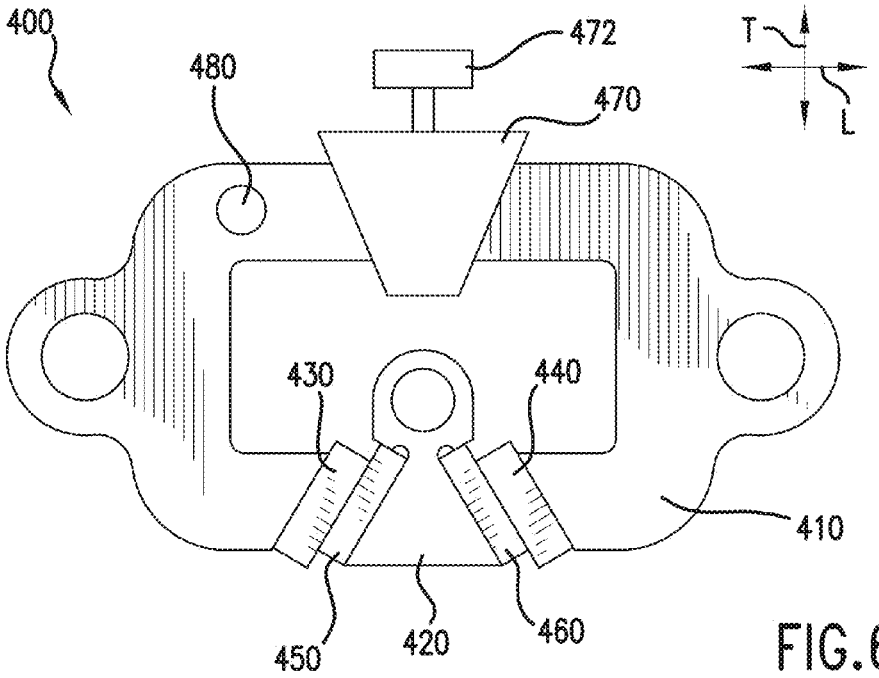
FIG. 6 provides a top, elevation view of a latch assembly according to an additional exemplary embodiment of the present subject matter.

FIG. 6 provides a top, elevation view of a latch assembly 400 according to an additional exemplary embodiment of the present subject matter. Latch assembly 400 is similar to latch assembly 300 (FIG. 3) and operates in a similar manner. Latch assembly 400 can be used for any suitable purpose. As an example, latch assembly 400 may be used on an appliance, such as washing machine appliance 100 (FIG. 1) or dryer appliance 200 (FIG. 2). As another example, latch assembly 400 may be used on a microwave appliance, a dishwasher appliance, a trash compactor, an oven appliance, etc.

Latch assembly 400 includes a back iron or stator 410, a mover 420, a first magnet 430, a second magnet 440, a third magnet 450 and a fourth magnet 460. First and second magnets 430 and 440 are mounted to stator 410. Conversely, third and fourth magnets 450 and 460 are mounted to mover 420. Like latch assembly 300 described above, first and second magnets 430 and 440 engage third and fourth magnets 450 and 460, respectively, to hold latch assembly 400 in a closed position. The position and orientation of first, second, third and fourth magnets 430, 440, 450 and 460 assist with shaping the force required to shift latch assembly 400 from the closed position to an open position. Latch assembly 400 also includes additional features for modifying and detecting a force applied by latch assembly 400.

A may be seen in FIG. 6, latch assembly 400 includes a breaker 470 and an actuator 472 (shown schematically). Actuator 472 is configured for moving breaker 470, e.g., along the transverse direction T, away from stator 410. With breaker 470 contacting stator 410 as shown in FIG. 6, breaker 470 and stator 410 form a closed magnetic circuit. Conversely, the magnetic circuit is interrupted if breaker 470 is moved away from stator 410, e.g., along the transverse direction T, by actuator 472. In such a manner, force applied by latch assembly 400 can be shaped or reduced. For example, a magnitude of the force applied by latch assembly 400 can be reduced when breaker 470 is spaced apart from stator 410, e.g., along the transverse direction T. Breaker 470 can be constructed from the same material as stator 410 or a different material. Actuator 472 can be any suitable mechanism for moving breaker 470. For example, actuator 472 may be a solenoid, a wax motor, a bimetal switch, a memory metal switch, a mechanical lever, etc.

Latch assembly 400 also includes a sensor 480 (shown schematically). Sensor 480 is configured for measuring or detecting a magnetic field within stator 410 and/or mover 420. Sensor 480 may be any suitable mechanism for detecting or measuring the magnetic field within stator 410 and/or mover 420. For example, sensor 480 may be a Hall Effect sensor, a reed switch, a leaf spring, an inductive loop, etc. When first, second, third and/or fourth magnets 430, 440, 450 and 460 engage each other to hold latch assembly 400 in the closed position, a magnetic field within stator 410 and/or mover 420 can be detected or measured by sensor 480. Based at least in part on the existence or strength of the magnetic field within stator 410 and/or mover 420, it can be inferred that latch assembly 400 is in the closed position. In particular, if sensor 480 detects the magnetic field in stator 410 and/or mover 420 or the magnetic field exceeds a particular strength, it can be inferred that latch assembly 400 is in the closed position.

Figure 7:
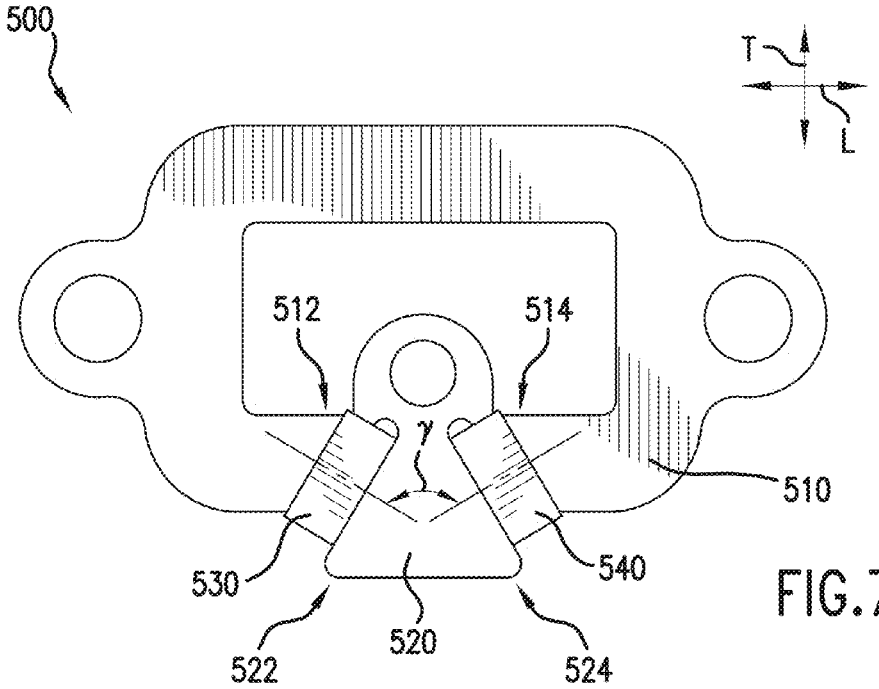
FIG. 7 provides a top, elevation view of a latch assembly according to another exemplary embodiment of the present subject matter.

FIG. 7 provides a top, elevation view of a latch assembly 500 according to another exemplary embodiment of the present subject matter. Latch assembly 500 is similar to latch assemblies 300 (FIG. 3) and 400 (FIG. 6) and operates in a similar manner. Latch assembly 500 can be used for any suitable purpose. As an example, latch assembly 500 may be used on an appliance, such as washing machine appliance 100 (FIG. 1) or dryer appliance 200 (FIG. 2). As another example, latch assembly 500 may be used on a microwave appliance, a dishwasher appliance, a trash compactor, an oven appliance, etc.

Latch assembly 500 includes a back iron or stator 510, a mover 520, a first magnet 530 and a second magnet 540. In the exemplary embodiment shown in FIG. 7, first and second magnets 530 and 540 are mounted to mover 520. However, in alternative exemplary embodiments, first and second magnets 530 and 540 may be mounted to stator 510. The position and orientation of first and second magnets 530 and 540 assist with shaping the force required to shift latch assembly 500 from the closed position to an open position.

As shown in FIG. 7, stator 510 has a first end portion 512 and a second end portion 514. First and second end portions 512 and 514 of stator 510 are spaced apart from each other, e.g., along the lateral direction L. Mover 520 also has a first end portion 522 and a second end portion 524. First and second end portions 522 and 524 of mover 520 are spaced apart from each other, e.g., along the lateral direction L. First magnet 530 is positioned at first end portion 512 of stator 510 and first end portion 522 of mover 520 when latch assembly 500 is in the closed position (shown in FIG. 7). Similarly, second magnet 530 is positioned at second end portion 514 of stator 510 and second end portion 524 of mover 520 when latch assembly 500 is in the closed position.

Central axis $C_2$ of second magnet 540 and central axis $C_1$ of first magnet 530 defines an angle γ therebetween, e.g., in a plane that is perpendicular to the vertical direction. The angle γ can be any suitable angle. For example, the angle γ may be between about one hundred and ten degrees and about one hundred and thirty degrees.

Figure 8:
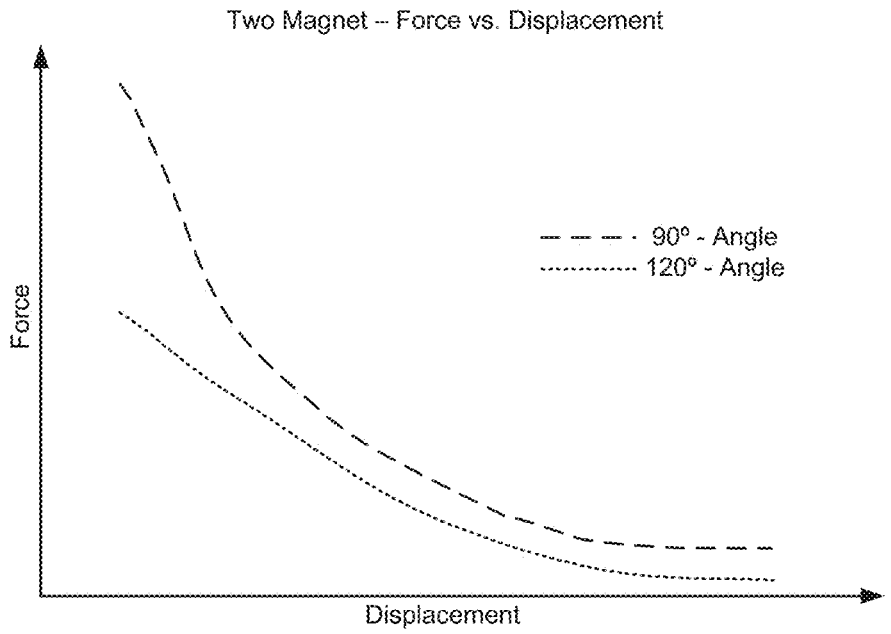
FIG. 8 illustrates exemplary graphs of forces applied by latch assemblies verses displacement of movers of the latch assemblies from stators of the latch assemblies.

FIG. 8 illustrates exemplary graphs of forces applied by latch assembly 500 with various angles γ verses displacement of mover 520 of latch assembly 500 from stator 510 of latch assembly 500. Operation of latch assembly 500 is described below with reference to FIG. 8. It should be understood the graphs of FIG. 8 are provided by way of example only and are not intended to limit the present subject matter to the force versus displacement curves shown in FIG. 8.

As may be seen in FIG. 8, a peak and magnitude of force of latch assembly 500 when angle γ is ninety degrees is greater than the peak force of latch assembly 500 when angle γ is one hundred and twenty degrees. Thus, by adjusting the angle γ, the peak and magnitude of force applied by latch assembly 500 can be adjusted or shaped. Magnets of latch assembly 300 (FIG. 3) and latch assembly 400 (FIG. 6) can be adjusted in a similar manner to adjust a respective peak and magnitude of force applied by latch assembly 500.

Figure 10:
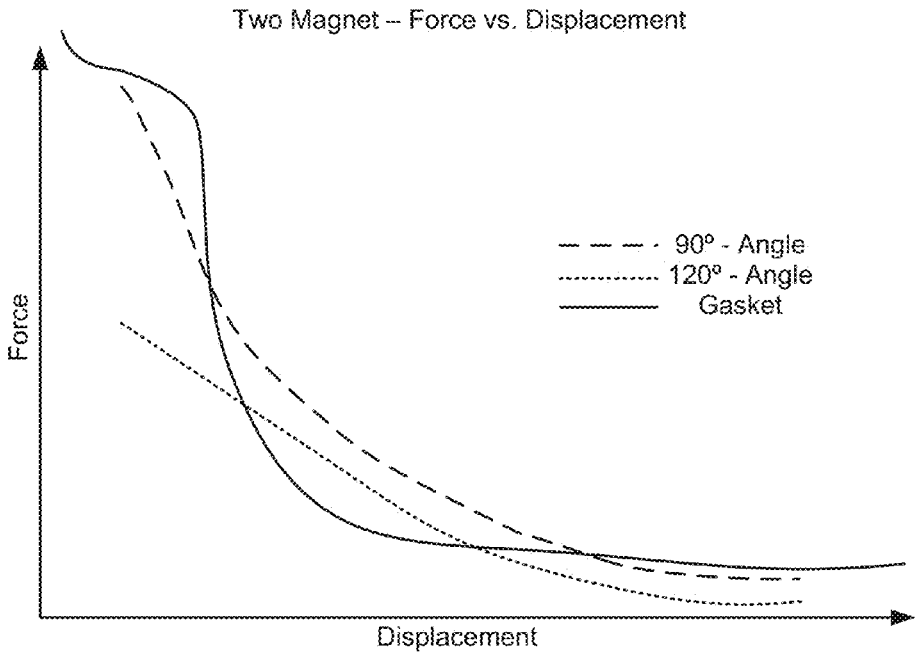
FIG. 10 illustrates exemplary graphs of forces applied by latch assemblies verses displacement of movers of the latch assemblies from stators of the latch assemblies and also illustrates a graph of a force applied by a gasket.
Figure 11:
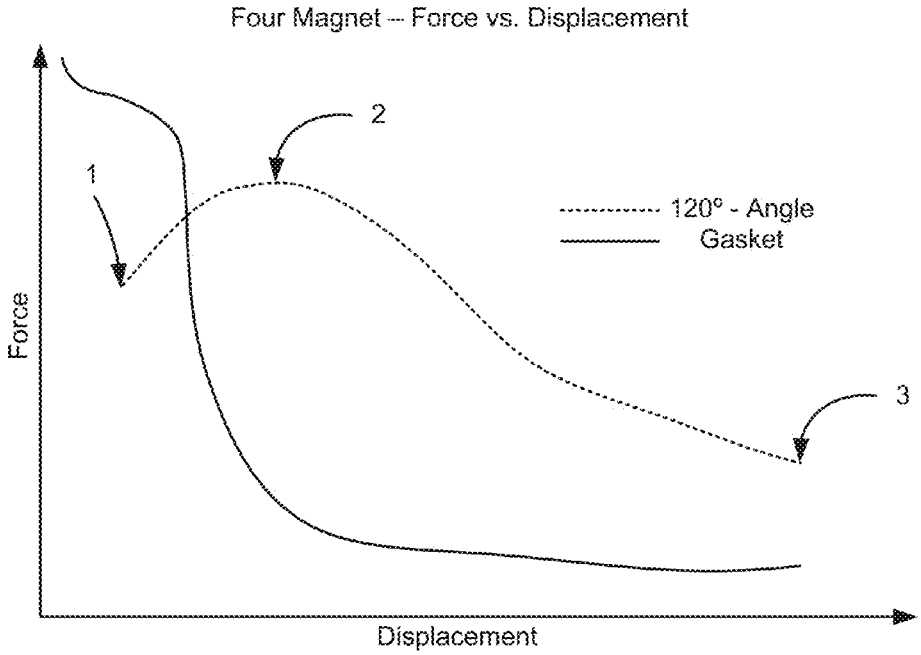
FIG. 11 illustrates another exemplary graph of a force applied by a latch assembly verses displacement of a mover of the latch assembly from a stator of the latch assembly and also illustrates a graph of a force applied by a gasket.

FIG. 10 illustrates the exemplary graphs of FIG. 8 and also illustrates a graph of force applied by a gasket. FIG. 11 illustrates the exemplary graph of FIG. 9 and also illustrates the graph of force applied by the gasket. As will be understood by those skilled in the art, when latch assembly 300 or latch assembly 500 is used on a door of an appliance, such as washing machine appliance 100 (FIG. 1) or dryer appliance 200 (FIG. 2), such appliance generally includes a gasket between the door and a cabinet of the appliance. The gasket applies a force to the door as it is closed that must be overcome to close properly or securely.

Comparing FIGS. 10 and 11, it can be seen that the force applied by latch assembly 300 exceeds the force applied by the gasket between point 2 and point 3 and intercepts the force applied by the gasket between point 1 and point 2 at a single location. Thus, latch assembly 300 draws latch assembly 300 towards the closed position until the force applied by latch assembly 300 equals the force applied by the gasket between point 1 and point 2. Conversely, the force of applied by the gasket exceeds the force applied by latch 500 except for a short interval. Thus, a user of the appliance must overcome the force applied by the gasket to close latch assembly 500 and latch assembly 500 has multiple closure positions where the force applied by latch assembly 500 equals the force applied by the gasket and latch assembly 500 will settle.

It should be understood that in the exemplary embodiments discussed above the magnetic material of latch assemblies 300, 400 and 500 need not touch to hold latch assemblies 300, 400 and 500 in a closed position. Thus, the magnetic material of the magnets can be spaced apart from each other in the closed position, e.g., due to plastic coating applied to such magnets in order to protect and improve durability of such magnets.

Figure 12:
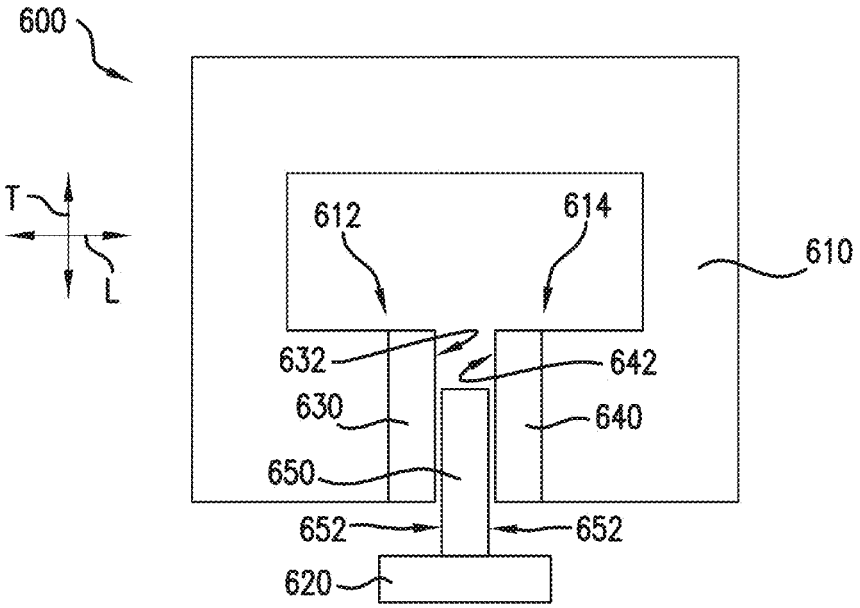
FIGS. 12, 13 and 14 provide top, elevation views of a latch assembly according to an exemplary embodiment of the present subject matter with a mover of the exemplary latch assembly shown in various positions relative to a stator of the exemplary latch assembly.
Figure 13:
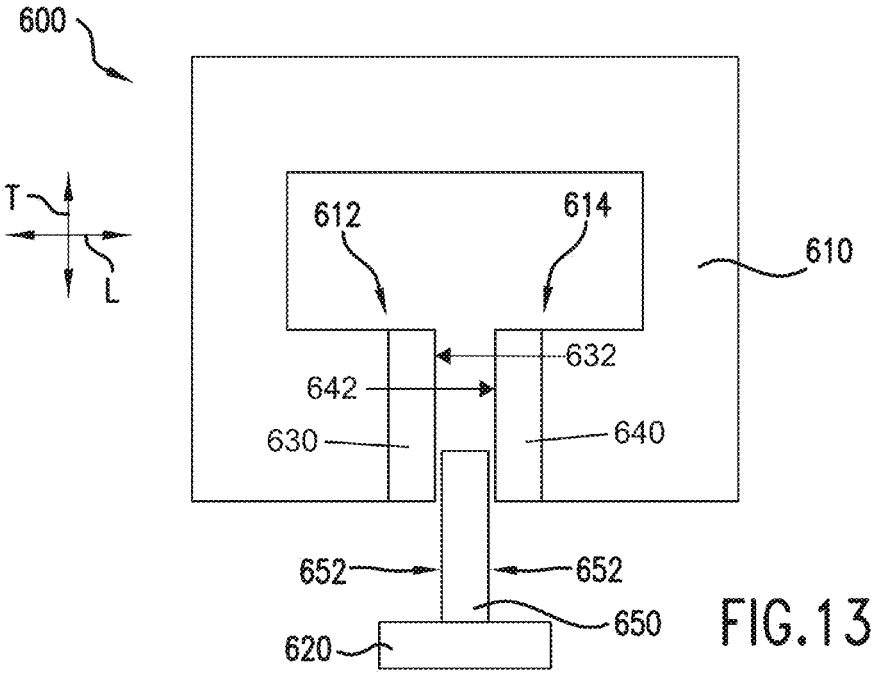
Figure 14:
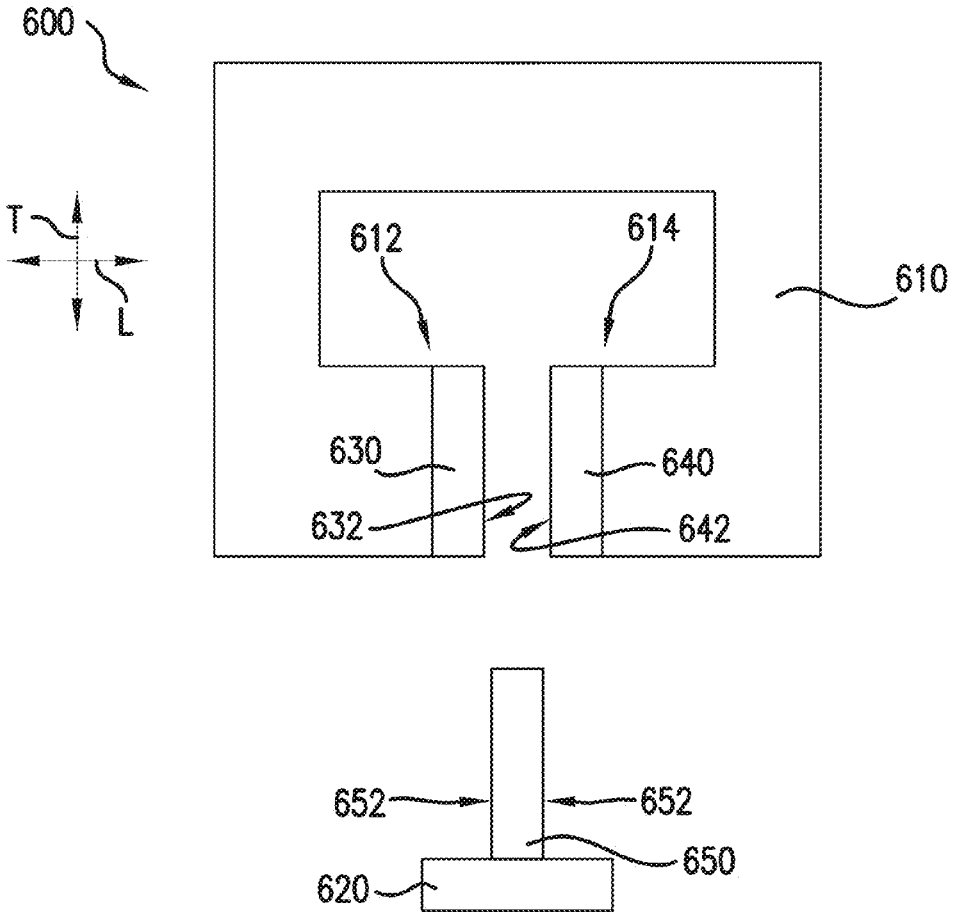

FIGS. 12, 13 and 14 provide top, elevation views of a latch assembly 600 according to an exemplary embodiment of the present subject matter. In FIGS. 12, 13 and 14, a mover 620 of latch assembly 600 is shown in various positions relative to a stator 610 of latch assembly 600. Latch assembly 600 is similar to latch assembly 300 (FIG. 3) and operates in a similar manner. Latch assembly 600 can be used for any suitable purpose. As an example, latch assembly 600 may be used on an appliance, such as washing machine appliance 100 (FIG. 1) or dryer appliance 200 (FIG. 2). As another example, latch assembly 600 may be used on a microwave appliance, a dishwasher appliance, a trash compactor, an oven appliance, etc.

Latch assembly 600 includes a back iron or stator 610, a mover 620, a first magnet 630, a second magnet 640 and a third magnet 650. First and second magnets 630 and 640 are mounted to stator 610. Conversely, third magnet 650 is mounted to mover 620. Like latch assembly 300 described above, first and second magnets 630 and 640 engage third magnet 650 to hold latch assembly 600 in a closed position. The position and orientation of first, second, third and fourth magnets 630, 640 and 650 assist with shaping the force required to shift latch assembly 600 from the closed position to an open position.

Stator 610 extends between a first end portion 612 and a second end portion 614. First and second end portions 612 and 614 of stator 610 are spaced apart from each other, e.g., along the lateral direction L. First magnet 630 is mounted to stator 610 at first end portion 612 of stator 610, and second magnet 640 is mounted to stator 610 at second end portion 614 of stator 610. Thus, first and second magnets 630 and 640 are spaced apart from each other, e.g., along the lateral direction L.

In FIG. 12, latch assembly 600 is shown in the closed position. In FIG. 14, latch assembly 600 is shown in the open position. Latch assembly 600 is shown between the open and closed positions in FIG. 13. As may be seen in FIG. 14, first magnet 630 has an outer surface 632, and second magnet 340 also has an outer surface 642. Third magnet 650 has a pair of outer surfaces 652, e.g., that are substantially parallel to each other. As may be seen in FIG. 12, third magnet 650 is positioned between first and second magnets 630 and 640 when latch assembly 600 is in the closed position. In particular, each outer surface of outer surfaces 652 of third magnet 650 faces and is substantially parallel to a respective one of outer surface 632 of first magnet 630 and outer surface 642 of second magnet 650.

Latch assembly 600 may have a similar force shape to latch assembly 300 as shown in FIG. 9. In particular, the force applied by latch assembly 600 may decreases from the position shown in FIG. 13 to the position shown in FIG. 12 and from the position shown in FIG. 13 to the position shown in FIG. 14. Thus, the position shown in FIG. 13 can correspond to a peak force applied by latch assembly 600, and the force applied by latch assembly 600 can decrease as mover 620 is inserted into stator 610 and latch assembly 600 approaches the closed position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A latch mechanism, comprising:

a stator having a first end portion and a second end portion;

a first magnet positioned at the first end portion of the stator, the first magnet having an outer surface and a central axis;

a second magnet positioned at the second end portion of the stator, the second magnet having an outer surface and a central axis;

a mover having a first end portion and a second end portion;

a third magnet positioned at the first end portion of the mover, the third magnet having an outer surface and a central axis, the outer surface of the third magnet positioned at the outer surface of the first magnet when the latch mechanism is in a closed position, the central axis of the third magnet being offset from and parallel to the central axis of the first magnet when the latch mechanism is in the closed position; and a fourth magnet positioned at the second end portion of the mover, the fourth magnet having an outer surface and a central axis, the outer surface of the fourth magnet positioned at the outer surface of the second magnet when the latch mechanism is in the closed position, the central axis of the fourth magnet being offset from and parallel to the central axis of the second magnet when the latch mechanism is in the closed position.

2. The latch mechanism of claim 1, wherein a surface area of the outer surface of the first magnet and a surface area of the outer surface of the second magnet are about equal.

3. The latch mechanism of claim 2, wherein a surface area of the outer surface of the third magnet and a surface area of the outer surface of the fourth magnet are about equal.

4. The latch mechanism of claim 3, wherein the surface area of the outer surface of the first magnet, the surface area of the outer surface of the second magnet, the surface area of the outer surface of the third magnet and the surface area of the outer surface of the fourth magnet are about equal.

5. The latch mechanism of claim 1, wherein the stator includes a first elongated portion and a second elongated portion, the first and second elongated portions of the stator defining an angle $\alpha$ therebetween, the angle $\alpha$ being between about fifty degrees and about seventy degrees.

6. The latch mechanism of claim 5, wherein the mover includes a first elongated portion and a second elongated portion, the first and second elongated portions of the mover defining an angle $\beta$ therebetween, the angle $\beta$ being between about fifty degrees and about seventy degrees.

7. The latch mechanism of claim 1, further comprising a stator holder that defines a recess and a mover holder, the stator mounted to the stator holder, the mover mounted to the mover holder, the mover holder received within the recess of the stator holder when the latch mechanism is in the closed position.

8. The latch mechanism of claim 7, wherein the stator and the mover are constructed with steel and the stator holder and mover holder are constructed with plastic.

9. The latch mechanism of claim 1, wherein the central axis of the first magnet and the central axis of the second magnet define an angle $\gamma$ therebetween, the angle $\gamma$ being between about one hundred and ten degrees and about one hundred and thirty degrees.

10. The latch mechanism of claim 1, wherein the central axis of the third magnet and the central axis of the fourth magnet define an angle $\delta$ therebetween, the angle $\delta$ being between about one hundred and ten degrees and about one hundred and thirty degrees.

11. A latch assembly, the latch assembly defining a lateral direction and a transverse direction, the lateral and transverse directions being perpendicular to each other, the latch assembly comprising:

a stator having a first end portion and a second end portion, the first and second end portions of the stator being spaced apart from each other along the lateral direction;

a first magnet mounted to the stator at the first end portion of the stator, the first magnet having an outer surface;

a second magnet mounted to the stator at the second end portion of the stator, the second magnet having an outer surface;

a mover having a first end portion and a second end portion, the first and second end portions of the mover being spaced apart from each other along the lateral direction;

a third magnet mounted to the mover at the first end portion of the mover, the third magnet having an outer surface, the outer surface of the third magnet facing and offset from the outer surface of the first magnet when the latch assembly is in a closed position, the outer surface of the third magnet overlapping the outer surface of the first magnet when the latch assembly is in the closed position; and a fourth magnet positioned at the second end portion of the mover, the fourth magnet having an outer surface, the outer surface of the fourth magnet facing and offset from the outer surface of the second magnet when the latch assembly is in the closed position, the outer surface of the fourth magnet overlapping the outer surface of the second magnet when the latch assembly is in the closed position.

12. The latch assembly of claim 11, wherein a surface area of the outer surface of the first magnet and a surface area of the outer surface of the second magnet are about equal.

13. The latch assembly of claim 12, wherein a surface area of the outer surface of the third magnet and a surface area of the outer surface of the fourth magnet are about equal.

14. The latch assembly of claim 13, wherein the surface area of the outer surface of the first magnet, the surface area of the outer surface of the second magnet, the surface area of the outer surface of the third magnet and the surface area of the outer surface of the fourth magnet are about equal.

15. The latch assembly of claim 11, wherein a normal line of the outer surface of the first magnet and a normal line of the outer surface of the second magnet define an angle $\gamma$ therebetween, the angle $\gamma$ being between about one hundred and ten degrees and about one hundred and thirty degrees.

16. The latch assembly of claim 11, wherein a normal line of the outer surface of the third magnet and a normal line of the outer surface of the fourth magnet define an angle $\delta$ therebetween, the angle δ being between about one hundred and ten degrees and about one hundred and thirty degrees.

* * * * *